United States Patent [19]

Luthi

[11] 4,297,794

[45] Nov. 3, 1981

[54] PAPER SHEET DRYER

[75] Inventor: Oscar Luthi, Nashua, N.H.

[73] Assignee: Ingersoll-Rand Company, Woodcliff Lake, N.J.

[21] Appl. No.: 821,167

[22] Filed: Aug. 2, 1977

[51] Int. Cl.[3] ..... F26B 11/04

[52] U.S. Cl. ..... 34/122; 34/115

[58] Field of Search ..... 34/110, 114, 115, 122

[56] References Cited

U.S. PATENT DOCUMENTS

| | | | |
|---|---|---|---|
| 2,141,377 | 12/1938 | Chylinski | 34/110 X |
| 3,246,400 | 4/1966 | Brown | 34/110 |
| 3,276,140 | 10/1966 | Walser et al. | 34/110 |
| 3,296,710 | 1/1967 | Krikorian | 34/110 X |
| 3,303,576 | 2/1967 | Sisson | 34/122 X |
| 3,304,626 | 2/1967 | Leckner | 34/122 X |
| 3,553,848 | 1/1971 | Kuroki et al. | 34/115 |
| 3,771,236 | 11/1973 | Candor et al. | 34/115 X |
| 3,946,497 | 3/1976 | Carter | 34/122 X |

*Primary Examiner*—Richard E. Gluck

*Attorney, Agent, or Firm*—Frank S. Troidl

[57] ABSTRACT

A continuous sheet of paper fibers is fed to a rotatable drum, moved around the rotatable drum by the rotatable drum, and is fed from the rotatable drum at an area circumferentially spaced from the paper fiber feed-in area. The sheet is supported on the drum by a high percentage open area sheet support. The sheet support has channels for conducting hot gas from the inside of the drum against the inside surface of the sheet. The support also has means for conducting the hot gas along the inside surface of the sheet.

16 Claims, 9 Drawing Figures

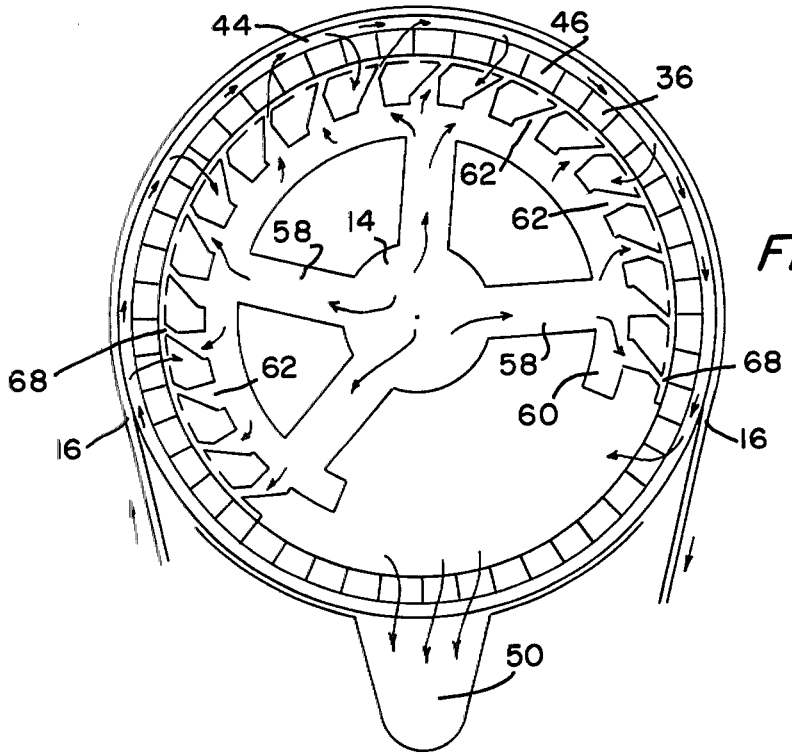
FIG. 3
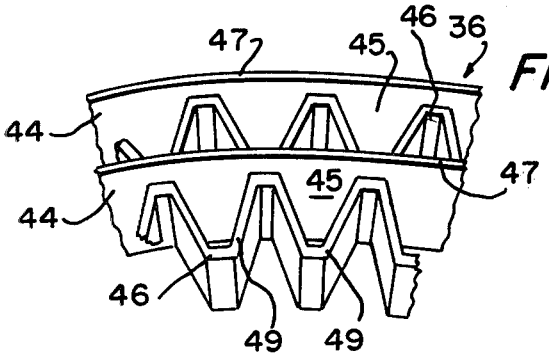
FIG. 5
FIG. 4
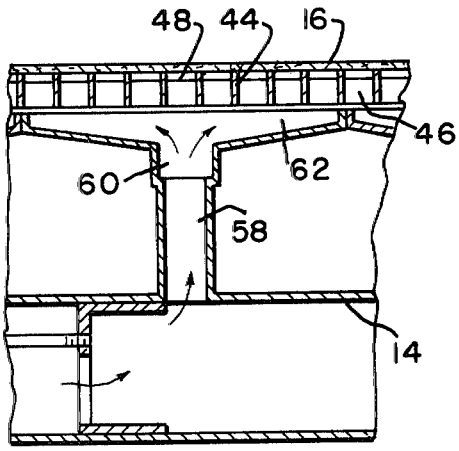
FIG.6
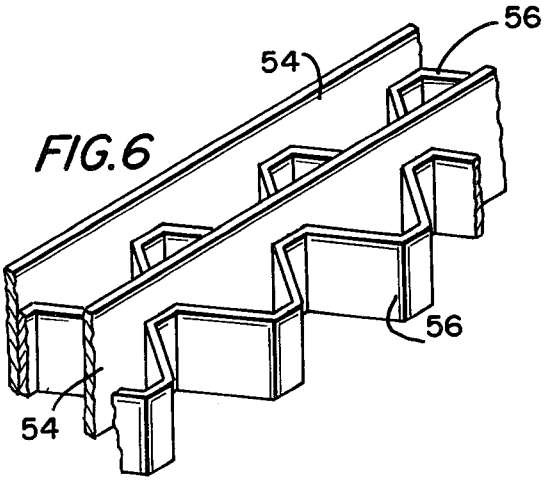

PAPER SHEET DRYER

This invention relates to the paper machine dryer section of a paper making system. More particularly, this invention is a dryer for drying a continuous sheet of paper fibers utilizing the impingement of a hot gas against the inside surface of the paper sheet.

In general, a paper machine includes a flow spreader for spreading the flow of stock from the delivery pipe into the machine, a head box or flow control system to improve the uniformity of stock flow, a Fourdrinier table section for draining excess liquid from the system, a press section to receive the wet web of paper removed from the Fourdrinier, a dryer section, a calendar stack for applying high ironing pressures to the dry sheet of paper, and a reel for winding up the dry paper into large rolls.

The traditional and most widely used dryer section consists of a series of cast iron steam heated rolls 48 to 60 inches in diameter. As it passes from the press section, the paper sheet consists of about 32% to 42% dry fiber. It is necessary to apply heat in order to reach the desired final state of dryness. The sheet is passed over and under the rolls until the desired dryness is reached, usually about 6% water content. The number of dryers is determined by the amount of water to be evaporated, the speed of the machine, and the weight of the sheet.

Unfortunately, the heat transfer rate on drum drying is generally slow. Paper machines with a hundred or more dryer rolls are not uncommon. Also, the paper web must be wrapped rather tightly around the drum to get intimate contact with the roll for heat transfer. Paper tends to shrink in the drying process, however, this shrinkage is constrained to a substantial degree due to the tight wrap of the sheet to the drying drums. Therefore, the paper must stretch, which reduces the strength and elasticity of the finished paper. The softness in tissue grades is also reduced due to the tight wrap and stretch.

Another type of dryer section may be called a through drying section. The wet paper is wrapped around a ribbed or perforated support. Heated air is introduced to the roll and forced entirely through the paper sheet. Through drying permits much higher drying rates, however, it is limited to porous grades, such as tissue, toweling, filter papers, roofing, and flooring felts.

Another type of dryer section consists of apparatus for outside impingement drying. Outside impingement drying is often used in conjunction with drum drying. It can also be used with through drying for less permeable sheets. A jet of high temperature gas from the outside is impinged onto the wet paper web. The impingement breaks up the vapor barrier and materially increases the water evaporation rate.

Outside impingement drying has not been used extensively in the paper making industry, in spite of its advantage in drying rate over the traditional and widely used drying cylinders. Outside impingement drying is mostly used where additional capacity is needed and adding more traditional drying cylinders is not feasible. The major disadvantage of outside impingement is the closeness of the impingement nozzles to the paper web. This complicates clean out after a paper web break. Also, heat distortion changes the nozzle-web distance which alters the drying rate.

This invention is a new apparatus for drying a paper sheet utilizing inside impingement drying. The inside impingement drying apparatus has a high heat transfer rate comparable to outside impingement drying. However, the inside impingement dryer does not have the disadvantages present in outside impingement because it has no tight fitting, closed hoods, there is no operational interference from nozzles, and there is no change in drying rate due to heat distortion.

Briefly described, the new inside impingement dryer includes a rotatable drum presenting a high percentage open area sheet support on the outside periphery of the drum. The sheet support has channels for conducting hot gas from the inside of the drum against the inside surface of the sheet. The support also provides the means for conducting hot gas along the inside surface of the sheet.

The invention, as well as its many advantages, may be further understood by reference to the following detailed description and drawings, in which:

FIG. 3 is a transverse sectional schematic view showing a second preferred embodiment of the invention;

FIG. 4 is a fragmentary view, on an enlarged scale, of a portion of the dryer of FIG. 3;

FIG. 5 is a perspective fragmentary view, on an enlarged scale, showing a portion of the circumferentially reinforced support;

FIG. 6 is a perspective fragmentary view, on an enlarged scale, of a longitudinally reinforced support;

In describing the various Figures, like parts are referred to by like numbers.

Figure 1:
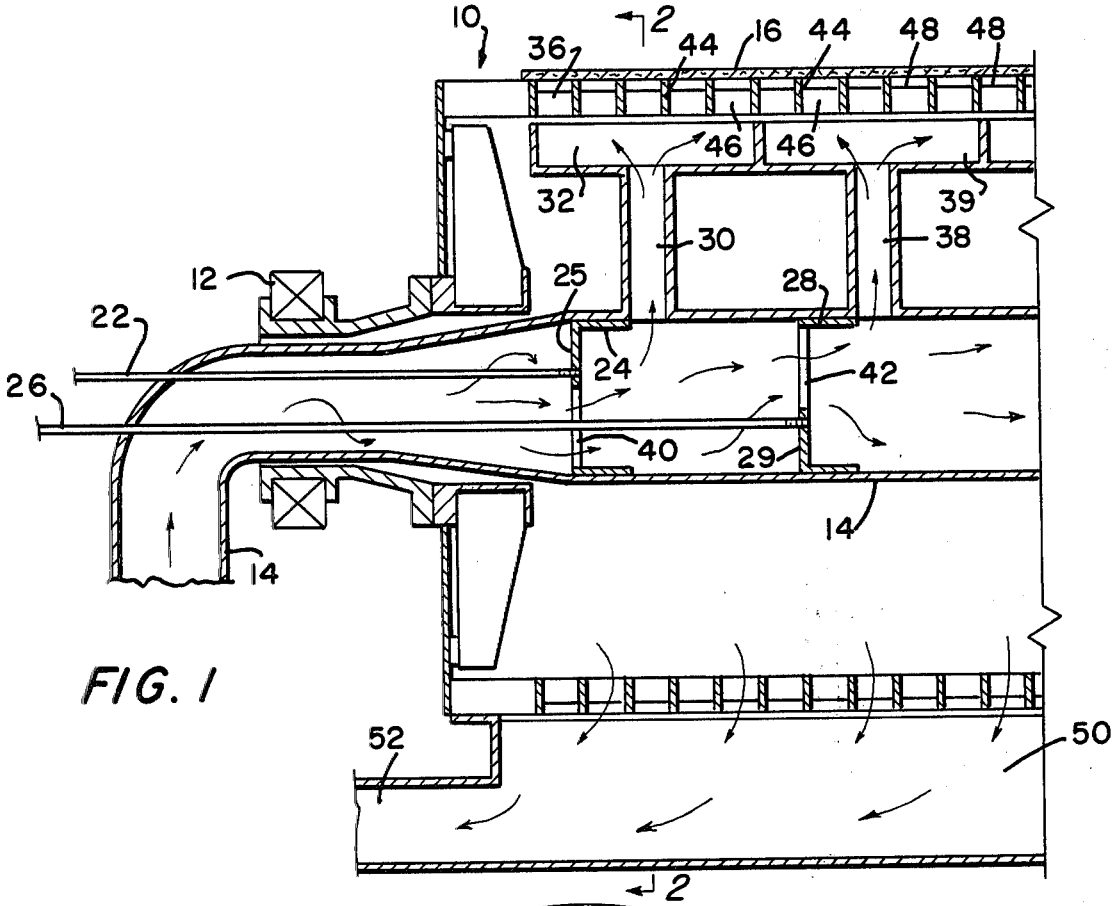
FIG. 1 is a side sectional view showing one preferred embodiment of the dryer.

Referring to the drawings and more particularly to FIG. 1, the new dryer includes a rotatable drum 10. The rotatable drum 10 may be mounted in a housing (not shown) and rotated within the bearing 12. Only half of the drum 10 is shown in the Figure, it being understood that the other half is similar in structure to the half shown.

Hot gas such as hot air, or steam, is fed to the inside of the rotatable drum 10 by means of gas conduit 14. The paper sheet 16 is fed to the rotatable drum 10, and contacts the outside periphery of the drum at area 18 (see FIG. 2). The paper sheet 16 leaves the drum 10 at an area 20 (see FIG. 2) circumferentially spaced from the area 18.

A plurality of longitudinally spaced sets of hot gas outlets provide hot gas zones. Each set includes a plurality of circumferentially spaced radially extending hot gas pipes connected to gas conduit 14. The circumferentially spaced radially extending hot gas pipes 30 (see FIG. 1 and FIG. 2) extend radially from the hot gas conduit 14 to a plurality of longitudinally extending pipe sections 32. Each pipe section 32 is provided with a slot 34 providing nozzles for directing the hot gas flow into a sheet support 36.

Similarly, a plurality of circumferentially spaced radially extending pipes 38 (only one shown in FIG. 1) are connected to the gas conduit 14 and lead to a plurality of pipe sections 39. Pipe sections 39, like pipe sections 32, each include a slot for feeding the hot gas into the sheet support 36. In a similar manner, more sets of pipes for feeding the gas to other parts of the sheet support 36 are provided, though not shown in the Figures. An arcuate member 21 connected to all the nozzles in all the hot zones is radially spaced from the inside radial surfaces of sheet support 36 and encompasses about the same arc of the drum as the sheet-drum contact arc. Hot gas flows inwardly through ports 31 provided in arcuate member 21 between the nozzles.

The amount of hot gas fed through pipes 30 is controlled by the axial position of ring 24 supported by ring support 25 on shaft 22 operated from outside the drum. Also, the amount of air fed through pipes 38 is controlled by the axial position of ring 28 supported by ring support 29 on shaft 26 operated from outside the drum. Gas may flow through gas port 40 in ring support 25 and may flow through gas port 42 in ring support 29. Thus, the amount of hot gas entering each zone may be adjusted for variations in moisture with respect to the longitudinal position of the parts of paper sheet 16.

The sheet support 36 must be a high percentage open area sheet support and preferably is constructed as shown in FIG. 5, which is a partial fragmentary view of the structure of the sheet support 36. The sheet support 36 includes a plurality of longitudinally separated curved flat strips 44 for supporting the sheet. The flat strips extend around the entire circumference of the drum with the length of the radially extending sides 45 being greater than the width of sides 47. A plurality of wavy strips 46 each extend circumferentially around the circumference of the drum and each wavy strip 46 interconnects a pair of adjacent curved flat strips 44.

The radius of the radial outer surfaces 49 of the wavy strips 46 is much smaller than the radius of the radial outer surfaces of the flat strips 44. Thus, the wavy strips 46 are recessed and therefore not only provide channels for the conduction of hot gas outwardly against the inside of the paper sheet, but also provide radial spaces or channels 48 for the flow of hot gas circumferentially along the inside surface of the sheet (see FIG. 1).

That portion of the drum circumference not encompassed by the arcuate member 21 is open, thus facilitating the flow of the used gas into the U-shaped channel 50 and out of the gas outlet 52. A second gas outlet similar to gas outlet 52 may be provided at the other longitudinal end (not shown) of the rotatable drum 10.

FIG. 6 shows an alternative sheet support which may be used in place of the sheet support shown in FIG. 5. FIG. 6, as with FIG. 5, is a fragmentary view of the sheet support. The sheet support includes a plurality of circumferentially separated longitudinally extending flat straight strips 54 for supporting the sheet. A plurality of wavy strips 56 extend longitudinally along the drum with each wavy strip interconnecting two adjacent flat strips 54. The wavy strips 56 are recessed with respect to the flat strips 54 to provide longitudinal spaces for the conduction of hot gas longitudinally along the inside surface of the sheet.

Figure 2:
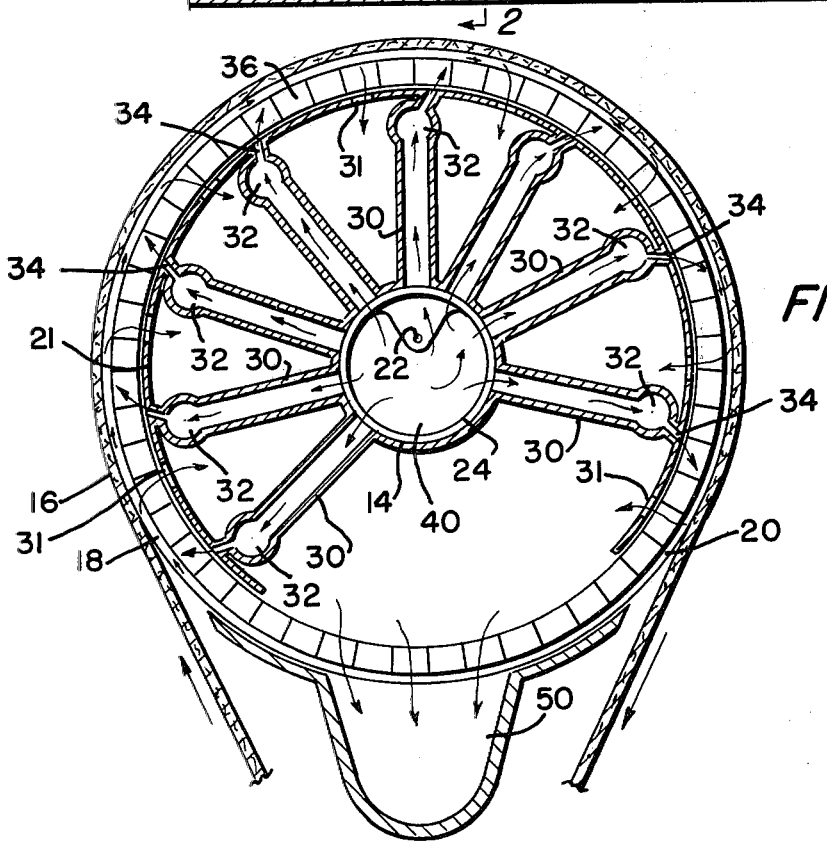
FIG. 2 is a view taken along lines 2—2 of FIG. 1 and in the direction of the arrows.
Figure 7:
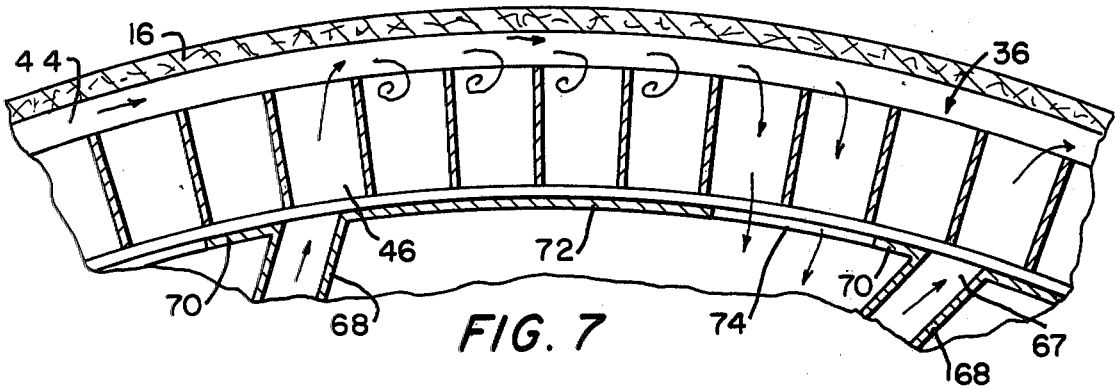
FIG. 7 is a sectional view, on an enlarged scale, showing the flow of hot gas in the reinforced support region.

In the embodiment shown in FIGS. 3, 4, and 7, the gas feeding system is somewhat different from the gas feeding system shown in the embodiment of FIG. 1 and FIG. 2. The gas inlet 14 feeds gas to a plurality of sets of gas conducting members each set including a plurality of radially extending gas pipes 58, which lead to an arcuately shaped manifold 60. From the manifold 60 the hot gas is fed to a plurality of gas conducting members 62 provided with slots 67 in nozzles 68. Nozzles 68 extend outwardly at an angle to the radius of the drum. As shown more clearly in FIG. 7, a short baffle plate 70 extends circumferentially in one direction from each nozzle 68 and a longer baffle plate 72 extends in the other direction circumferentially from each nozzle 68. The longer plate 72 is separated from the shorter plate 70 of the adjacent nozzle 68 to provide longitudinal openings 74 to permit the flow of hot gas back to the inside of the rotatable drum 10.

Figure 8:
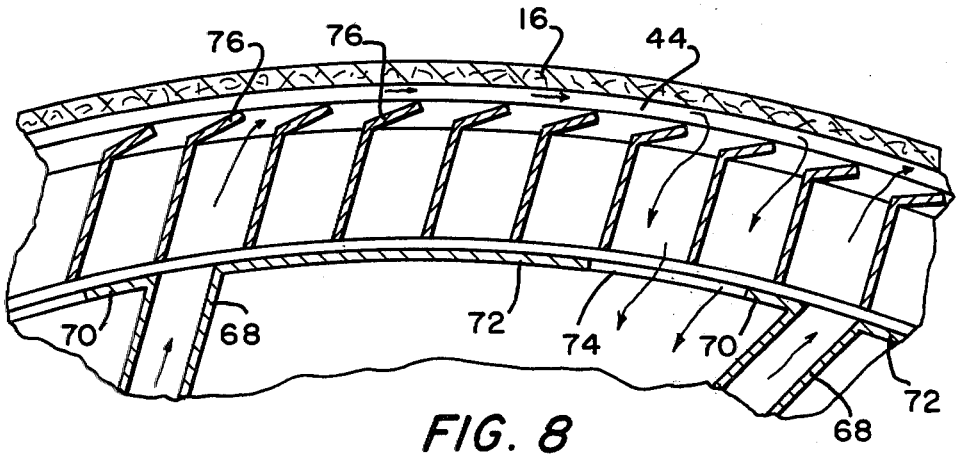
FIG. 8 is a sectional view, on an enlarged scale, showing the flow of hot gas in another preferred embodiment of reinforced support.

In the embodiment of FIG. 8, the high percentage open area sheet support is provided with deflectors 76 with a forward pitch to aid in the conduction of the hot gases circumferentially along the inside of the paper web 16.

Figure 9:
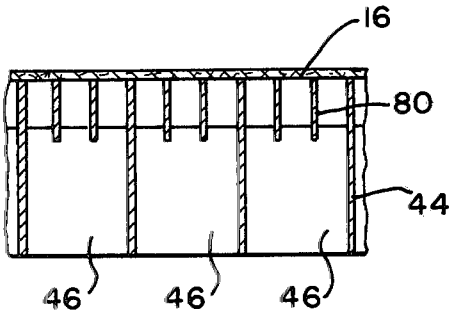
FIG. 9 is a sectional view of still another preferred embodiment of reinforced support.

In the embodiment shown in FIG. 9, the high percentage open area sheet support is provided with a plurality of wires 80 connected to each wavy member 46. The wires 80 provide additional support for the paper sheet 16.

In the operation of the embodiment of FIG. 1 and FIG. 2, the paper sheet 16 is fed to the drum 10 and past the drying nozzles. As the sheet is moved around by the drum 10, the hot gas fed into gas inlet 14 flows outwardly through the radial pipes into the longitudinally extending pipe sections and out of the nozzles. The gas from the nozzles will flow through the channels formed by the openings in the paper support 36 and then circumferentially along the inside of the paper sheet 16 in the spaces formed by the recessed wavy members between the flat members. The used gas leaves the rotatable drum by way of trough 50 and gas outlet 52.

The pressures are controlled so that the inside pressure, compared to the outside pressure is such that very little, if any, gas will go through the paper sheet 16. Substantially all of the drying is done entirely by the impingement from the inside of the air along the inside of the paper web 16. A vacuum may be applied to the inside of the drum 10 to hold the paper sheet to the drum.

If the support member shown in FIG. 6 is used on the drum rather the support member of FIG. 5, the operation will be substantially the same as the operation explained above, except that the gas will be conducted along the inside of the paper web longitudinally, rather than circumferentially. With slight modification of the structure shown in FIG. 5, such as by spirally winding strips 44, the gas will be conducted spirally along the inside of the sheet.

The operations of the embodiment shown in FIGS. 3, 4, and 7, as well as the modifications shown in FIGS. 8 and 9 are substantially the same as the operation of the embodiment of FIGS. 1 and 2, and it is believed the operation of these additional embodiments are readily understandable from the explanation of the operation of the embodiment of FIGS. 1 and 2. Also, other shapes of high percentage open area sheet supports may be used than the straight and wavy strip structure. For example, a perforated annular plate could be used with longitudinal strips with circumferential winding wire to support the paper sheet.

I claim:

1. A dryer for drying a continuous sheet of paper fibers comprising: a rotatable drum; a high percentage open area sheet support on the outside of said drum; means for feeding the sheet to the rotatable drum and means for removing the sheet from the drum at an area circumferentially spaced from the means for feeding the sheet to the rotatable drum, thus providing a sheet-drum contact arc; means for feeding hot gas into the inside of the rotatable drum; said sheet support having means for conducting hot gas from the inside of the drum against the inside of the sheet, and along the inside surface of the sheet; and means circumferentially spaced from said sheet-drum contact arc for flowing used gas out of the rotatable drum.

2. A dryer in accordance with claim 1 wherein: the means for feeding hot gas into the inside of the rotatable drum comprises: an axial hot gas inlet; and a plurality of spaced hot gas outlets leading from the axial hot gas inlet to adjacent the sheet support.

3. A dryer in accordance with claim 2 wherein the plurality of spaced hot gas outlets comprises: a plurality of longitudinally spaced sets of hot gas outlets, each set including a plurality of circumferentially spaced hot gas outlets.

4. A dryer in accordance with claim 1 wherein the high percentage open area sheet support has channels including a plurality of longitudinally separated flat strips for supporting the sheet extending around the entire circumference of the drum and a plurality of wavy strips each extending substantially circumferentially around the circumference of the drum and each connected to a pair of adjacent flat strips, the radial outer surfaces of the wavy strips having a smaller radius than the radial outer surfaces of the flat strips thereby providing means to conduct hot gas circumferentially along the inside surface of the sheet.

5. A dryer in accordance with claim 1 wherein: the high percentage open area sheet support has channels including a plurality of circumferentially separated longitudinally extending flat strips for supporting the sheet extending around the entire perimeter of the drum, and a plurality of wavy strips extending longitudinally along said drum with each wavy strip being connected to two adjacent flat strips, the radial outside surfaces of the wavy strips being less than the radial outside surfaces of the flat strips to provide passages for conducting gas longitudinally along the inside surface of the sheet.

6. A dryer in accordance with claim 4 wherein: a plurality of separated wires are connected to the outside radial edge of each wavy strip for providing additional support for the sheet.

7. A dryer in accordance with claim 6 wherein: the plurality of flat strips extend angularly with the radius of the drum, the angular extension being in the direction of the rotation of the drum.

8. A dryer for drying a continuous sheet of paper fibers comprising: a rotatable drum; a high percentage open area sheet support on the outside of said drum; means for feeding the sheet to the rotatable drum and means for removing the sheet from the drum at an area circumferentially spaced from the means for feeding the sheet to the rotatable drum thus providing a sheet-drum contact arc; an axial hot gas inlet; a plurality of spaced hot gas outlets leading from the axial hot gas inlet to adjacent the sheet support; said sheet support having means for conducting hot gas from said gas outlets against the inside of the sheet and along the inside surface of the sheet; an arcuate member adjacent the inside radial surfaces of the sheet support and encompassing approximately the same arc of the drum as the sheet-drum contact arc, said arcuate member having means permitting the flow of used hot gas radially inwardly into the drum; and means circumferentially spaced from sheet-drum contact arc for flowing used gas out of the rotatable drum.

9. A dryer for drying a continuous sheet of paper fibers comprising: a rotatable drum; a high percentage open area sheet support on the outside of said drum; means for feeding the sheet to the rotatable drum and means for removing the sheet from the drum at an area circumferentially spaced from the means for feeding the sheet to the rotatable drum thus providing a sheet-drum contact arc; an axial hot gas inlet; a plurality of spaced hot gas outlets leading from the axial hot gas inlet to adjacent the sheet support; said sheet support having means for conducting hot gas from said gas outlets against the inside of the sheet and along the inside surface of the sheet; axially movable hot gas control means located within said axial hot gas inlet, the amount of hot gas fed through said hot gas outlets being controlled by the axial position of said hot gas control means; an arcuate member adjacent the inside radial surfaces of the sheet support and encompassing approximately the same arc of the drum as the sheet-drum contact arc, said arcuate member having means permitting the flow of used hot gas radially inwardly into the drum; and means circumferentially spaced from sheet-drum contact arc for flowing used gas out of the rotatable drum.

10. A dryer for drying a continuous sheet of paper fibers comprising: a housing; a rotatable drum mounted in said housing; a high percentage open area sheet support on the outside of said drum; means for feeding the sheet to the rotatable drum and means for removing the sheet from the drum at an area circumferentially spaced from the means for feeding the sheet to the rotatable drum, thus providing a sheet-drum contact arc; means for feeding hot gas into the inside of the rotatable drum; said sheet support having means for conducting hot gas from the inside of the drum against the inside of the sheet, and along the inside surface of the sheet; means for returning used gas to the inside of said rotatable drum at points spaced from where the hot gas was conducted against the inside of the sheet; and a gas outlet connected to said housing for removing returned used gas from the inside of the rotatable drum.

11. A dryer in accordance with claim 10 wherein: the means for feeding hot gas into the inside of the rotatable drum comprises: an axial hot gas inlet; and a plurality of spaced hot gas outlets leading from the axial hot gas inlet to adjacent the sheet support.

12. A dryer in accordance with claim 11 wherein the plurality of spaced hot gas outlets comprises: a plurality of longitudinally spaced sets of hot gas outlets, each set including a plurality of circumferentially spaced hot gas outlets.

13. A dryer in accordance with claim 10 wherein: the high percentage open area sheet support has channels including a plurality of longitudinally separated flat strips for supporting the sheet extending around the entire circumference of the drum and a plurality of wavy strips each extending substantially circumferentially around the circumference of the drum and each connected to a pair of adjacent flat strips, the radial outer surfaces of the wavy strips having a smaller radius than the radial outer surfaces of the flat strips thereby providing means to conduct hot gas circumferentially along the inside surface of the sheet.

14. A dryer in accordance with claim 10 wherein: the high percentage open area sheet support has channels including a plurality of circumferentially separated longitudinally extending flat strips for supporting the sheet extending around the entire perimeter of the drum, and a plurality of wavy strips extending longitudinally along said drum with each wavy strip being connected to two adjacent flat strips, the radial outside surfaces of the wavy strips being less than the radial outside surfaces of the flat strips to provide passages for conducting gas longitudinally along the inside surface of the sheet.

15. A dryer in accordance with claim 13 wherein: a plurality of separated wires are connected to the outside radial edge of each wavy strip for providing additional support for the sheet.

16. A dryer in accordance with claim 15 wherein: the plurality of flat strips extend angularly with the radius of the drum, the angular extension being in the direction of the rotation of the drum.

* * * * *